United States Patent [19]

Kraus

[11] 4,183,982

[45] Jan. 15, 1980

[54] FLUID PROTECTIVE WALL COVER IN A VAPOR DEPOSITION CHAMBER

[75] Inventor: Thaddaus Kraus, Triesen, Liechtenstein

[73] Assignee: Balzers Aktiengesellschaft fur Hochvakuumtechnik und Dunne Schichten, Liechtenstein

[21] Appl. No.: 903,173

[22] Filed: May 5, 1978

[30] Foreign Application Priority Data

May 9, 1977 [CH] Switzerland ..... 005741/77

[51] Int. Cl.[2] ..... B05D 1/00; C23C 11/00

[52] U.S. Cl. ..... 427/248 R; 118/49; 427/294

[58] Field of Search ..... 427/248–255, 427/294–296, 166, 167, 99, 107, 51, 109, 69, 78, 50; 65/60; 118/48–49.5; 148/174, 175

[56] References Cited

U.S. PATENT DOCUMENTS

| | | | |
|---|---|---|---|
| 3,183,888 | 5/1965 | Blackman | 118/715 |
| 3,201,290 | 8/1965 | Wyss | 148/16.5 |
| 3,446,659 | 5/1969 | Wisman | 427/93 |
| 3,466,191 | 9/1969 | Stinchfield | 427/248 B X |
| 3,573,888 | 4/1971 | Bogart | 427/255 X |
| 3,649,339 | 3/1972 | Smith | 118/49 X |
| 3,800,738 | 4/1974 | Tassara | 118/49 X |
| 3,876,410 | 4/1975 | Scholes | 65/60 R |
| 3,974,003 | 8/1976 | Zirinsky et al. | 427/248 B X |
| 4,046,101 | 9/1977 | Winkler | 118/49.1 |

*Primary Examiner*—Morris Kaplan
*Attorney, Agent, or Firm*—McGlew and Tuttle

[57] ABSTRACT

A method of producing a high vacuum in a vacuum container which has an exhaust connection line connected thereto and using an interior protective covering for the walls of the container and a protective gas comprises, applying covering to the interior of the container so as to shield the inner walls thereof and to also shield the exhaust connection thereto, directing a protective gas into the space between the covering the interior walls of the container, preferably during the flooding in which the container is opened, and thereafter evacuating the interior of the container through the exhaust connection and heating the covering. The vacuum treatment device, such as a device for evaporating materials from vapor deposition, comprises a closed container having interior walls with a thin-walled metal sheet forming a covering arranged in spaced relationship to the interior walls so as to shield a major area of the walls and to define a space between the walls and the covering. A connecting line for introducing a protective gas into the container in the space between the walls and the covering is provided, and in addition an exhaust gas line is connected to the container and to an evacuating pump for evacuating the container. A thin-walled metal screen is arranged in the container and shields at least a portion of the exhaust line, and heater means are provided for heating both the covering and the shield.

8 Claims, 2 Drawing Figures

FLUID PROTECTIVE WALL COVER IN A VAPOR DEPOSITION CHAMBER

BACKGROUND OF THE INVENTION

1. Field of the Invention

This invention relates in general to a vacuum treatment device and specifically to method of producing a high vacuum in a container which has an interior thin metal sheet spaced from the walls thereof on the inside of the container defining a space therebetween which is connected at one end to an exhaust connection which includes means for introducing a protective gas in the space between the sheet and the interior walls, and for heating the covering for the interior walls.

2. Description of the Prior Art

During the evacuation of a container, the pressure in the high vacuum range depends primarily on the suction capacity of the pumping system and on the amount of vapor (chiefly water vapor) which, during the preceding contact with vapor-containing air, has been sorbed to the inside walls of the container and is slowly released again under the high-vacuum conditions. For this reason, efforts in the high-vacuum technology have continually been directed to maximum possible suction capacity and a minumum possible amount of sorbed vapor.

Opposed to the unlimited increase of the suction capacity, however, are not only the growing costs of larger pumps but also some undesirable consequences related to the vacuum technique. That is, the relative difference between the particle number density in the gas space reached in the container during the pumping, and the particle number density determined by the vapor amount sorbed by the container walls under equilibrium conditions, increases approximately proportionally to the increasing suction capacity. The local differences in the volumetric particle density or in the collision rate by surface within the container, caused by the geometry of the container and any built-in equipment, grow larger in the same proportion. Such differences, however, jeopardize a representative checking of the determinative parameters of the process (for example, the measuring of pressure). Thus, with the augmented suction capacity, the risk increases of unduly affecting the reproducibility of the results of the vacuum process (for example, of the optical properties of thin layers deposited by evaporation in vacuum), even if the differences are very small, such as caused by the spatial arrangement of the built-in equipment, the temperature distribution or temperature variation.

Thus the reduction of the sorbed amount of vapor offers particular advantages over an enhancement of the suction capacity, which advantages, as mentioned above, not only include savings in the size of pumps but are also of a technological nature.

A well-known manner of reducing the sorption is to prevent air from contacting the inside walls of the container and to introduce and remove the pieces to be treated through vacuum-tight air locks. The result obtained, however, does not always justify the high technical expenditures of pressure-tight locks and of auxiliary means for actuating the locks and transporting the pieces to be treated. That is, if during the maintenance or cleaning, the inside walls of the container come even only temporarily in contact with vapor-containing air, the reestablishment of constant process parameters requires a new, relatively long recovery time.

It is known to prevent humid air from penetrating into an open container by flooding the inside walls thereof with a stream of dry gas (protective gas). In this method of the prior art, no pressure-tight locks are needed, however, there is a disadvantage in a large consumption of protective gas.

Also known is to apply a higher, constant temperature, in order to reduce the water adsorption on a container wall. In this method, because of the increased saturation pressure of the water vapor, the relative humidity of the air is reduced (ratio of the partial pressure of the water vapor to the saturation pressure thereof), whereby the amount of sorbed water is also reduced. However, since at a higher temperature the sorbed water amount equilibrates a larger volumetric particle number in the gas space, the obtained effect is relatively small.

Better results are obtained by alternately heating and cooling the inside walls during the evacuation. The temperature is varied periodically in accordance with the cycle of consecutive evacuation processes, predominantly with the aid of fluid heat carriers. During the flooding, the temperature is kept above the dew point given by the air humidity, but mostly not above 60° C., in order not to complicate the maintenance and not to intensify the corrosion.

A further improvement is obtained by heating the container walls during the evacuation to temperatures above 60° C. To accelerate the temperature variation and save energy, it has also been provided to cover the inside walls of the container with heatable protective screens, for example, metal foils, spaced therefrom. The intention was to protect the inside walls from vapor deposition. In this way, particuarly in vacuum coaters, the porous, strongly sorbing vapor-deposited layers can be prevented from forming on the inside walls, while the protective screens coated with such layers may easily be outgassed by heating during the evacuation and thereby regenerated, or they may be exchanged. Experience has been made, however, that the pressure drop thereby obtained in the container is still substantially smaller than that which could theoretically be expected on the basis of the temperature drop.

SUMMARY OF THE INVENTION

The present invention is directed to measures for increasing the pressure drop produced by heating and cooling.

To this end, the inventive method of producing high vacuum in a container into which, at least during the period of flooding, a protective gas is introduced to protect the inside wall from being charged with vapor, providing that the inside wall is largely screened by a covering and the protective gas is introduced into the intermediate space formed between the container wall and the covering, and that during the following evacuation, the covering is heated.

The protective gas is introduced primarily during the flooding of the container and while the container is open. During the following evacuation, the gas feed may be throttled and then, upon accomplishing the heating, shut off.

It is advisable to shield also the exhaust connection against the penetration of vapor-containing air, by a heatable, thin-walled flap or movable screen, as well as by suitably directing the vapor-free protective gas, with the flap or movable screen being fully opened during the heating, but brought, after the heating, into a position in which it is adjusted to a gas conductance at which the pressure in the container assumes a minimum value, and closed during the flooding.

Another improvement may be obtained by designing the exhaust connection or the covering placed in front of the inside wall thereof, as a cool trap, sorption trap, or decomposition trap, for example.

The protective gas consumption may be reduced by minimizing the width of the exit slits from the screened cavities between the inside walls of the container and the covering. But on the other hand, the exit slits must be sufficiently large to permit a satisfactorily quick pressure equalization and to prevent damaging of the thin covering by too high differential pressures during the evacuation or flooding. As far as possible, the covering should screen the inside wall of the container completely, without contacting it, and all portions thereof should be heatable. Further, the covering is to be as thin-walled as possible, to ensure a quick drop of its temperature and of the pressure in the container after the heat supply is switched off. For example, with coverings of a 0.01 mm thick copper foil, the cooling period up to reaching a substantially constant pressure amounts to 20 seconds at most. In contradistinction thereto, a sheet metal covering having a thickness of 1 mm requires a 10 to 20 times longer cooling time and a much higher wattage to obtain the same pressures.

For the heat supply, electrically heated radiation sources for example electric heating wires of up to 2 mm in diameter, are particuarly suitable, because they cool down sufficiently quick after the current is switched off.

The heating of the 0.01 mm thick copper foil to temperatures between 100° and 200° C. requires only a few minutes, taking into account a wattage of 1 to 2 kW per $m^2$ of the surface area of the covering. By heating such a thin covering in accordance with the disclosed method, not only the pressure in the container but also the pumping time is reduced to fractions of the comparable values in isothermal processes.

To illustrate the method of the invention, there is provided a vacuum treatment device which comprises a closed container having an interior walls with thin-walled metal sheet forming a covering arranged in spaced relationship to the walls to as to shield the major area of the walls, and to define a space between the walls and the covering with means for introducing a protective gas into the space with an exhaust gas line connected into the container with evacuating pump means associated therewith for evacuating the container wherein there is a thin-walled metal screen in the container shielding at least a portion of the exhaust line, and there are heating means for heating the covering and the shield.

A further object of the invention is to provide a method of producing high vacuum in a vacuum container which has an exhaust connection line connected thereto, using an interior protective covering and a protective gas which comprises applying the covering to the interior of the container so as to shield the inner walls thereof and at least a portion of the exhaust connection and directing a protective gas into the space between the covering and the interior walls of the container, and thereafter evacuating the interior of the container through the exhaust connection and heating the covering.

The various features of novelty which characterize the invention are pointed out with particularity in the claims annexed to and forming a part of this disclosure. For a better understanding of the invention, its operating advantages and specific objects attained by its uses, reference is made to the accompanying drawing and descriptive matter in which a preferred embodiment of the invention is illustrated.

GENERAL DESCRIPTION OF THE PREFERRED EMBODIMENTS

Figure 1:
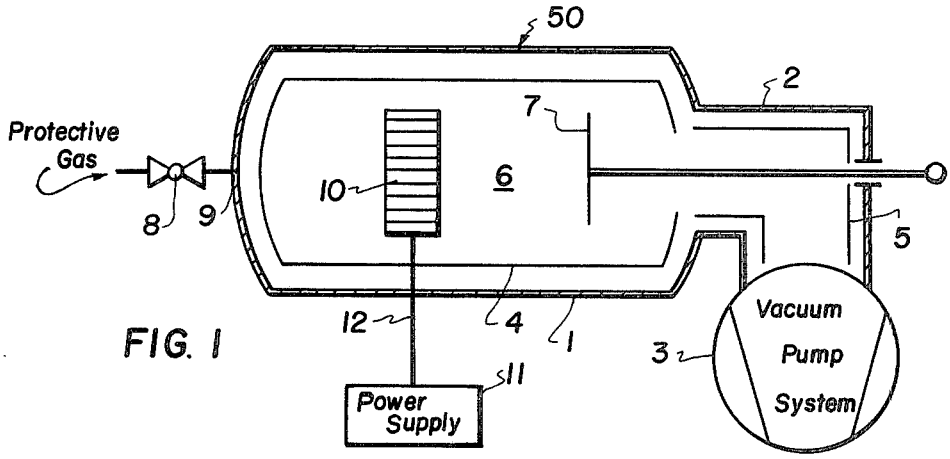
FIG. 1 is a somewhat schematic representation of a vacuum treatment device constructed in accordance with the invention.

Referring to the drawings in particular, the apparatus embodied therein comprises a vacuum treatment device generally designated 50 which may be used for carrying out the method of the invention for producing a high vacuum in a vacuum container, comprising a container 1 as shown in FIG. 1.

The container 1 is connected, through an exhaust connection 2, to a high vacuum pumping system 3. The inside walls of the container and exhaust connection are screened by thin metal sheets 4, 5. As a further portion of the screening or covering, an adjustable thin-walled screen 7 is provided between exhaust connection 2 and the space 6. Through a valve 8 and a connecting line 9, protective gas can be fed into the cavities formed between sheets 4, 5 and the inside walls of the container and the exhaust connection. The covering is advantageously heated by means of a suitable heater 10. The heater 10 comprises an electric radiating heating body which is energized from a supply unit 11 through a line 12 passed through the container wall.

Figure 2:
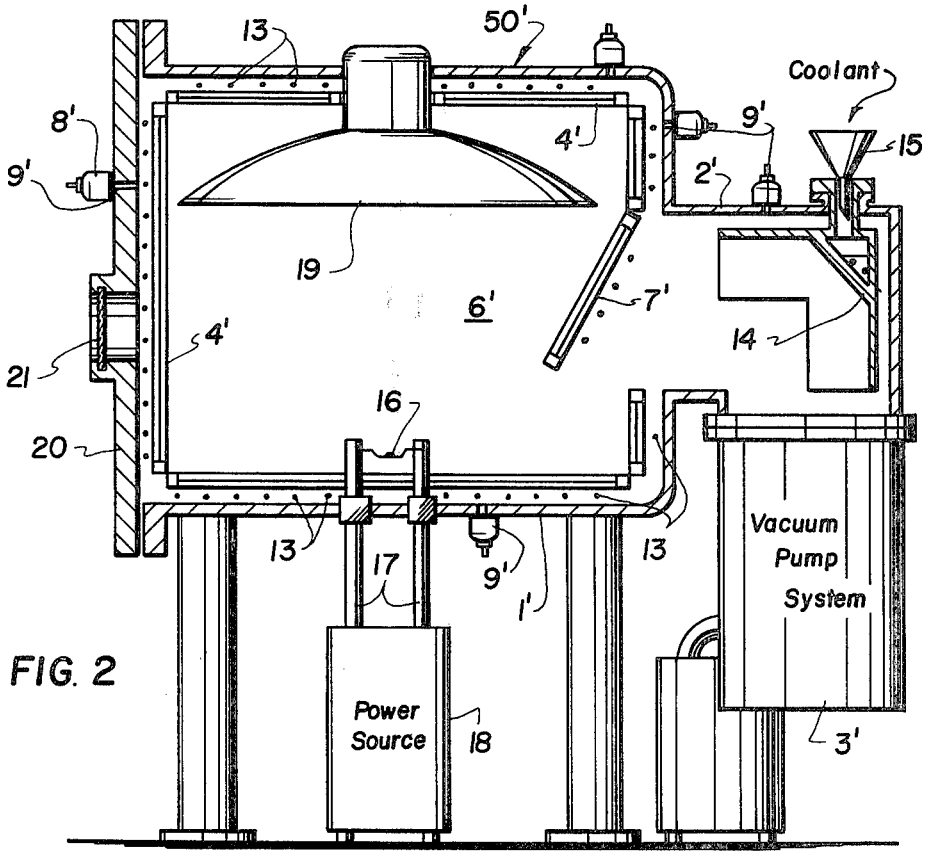
FIG. 2 is a vapor deposition apparatus in which the method of the invention may be carried out.

FIG. 2 shows an embodiment of a vacuum coater designed for carrying out the inventive method. Corresponding elements are designated as in FIG. 1 but with primes. Here again, the container walls are largely covered with thin metal sheets 4', so that only suction slits are left between the individual parts of the covering, to be able to evacuate or flood the intermediate space.

As heating elements, electric heating wires 13 are shown in FIG. 2 which extend in the intermediate space. An adjustable flap $7^1$, comparable to the screen 7 of FIG. 1 and representing a portion of the covering, is also equipped with such heating wires, at its side remote from space 6'. A plurality of protective gas connections 9' is provided, to be able to bring the protective gas securely in contact with all portions of the inside wall of the container. In an exhaust connection 2', a cool trap 14 is provided which can be supplied with a coolant through a funnel 15. For its operation as a vapor-depositing unit, the apparatus is equipped with an evaporation device 16 known per se which is supplied with current from a power source 18, through lines 17. Opposite to the evaporation device, a rotary supporting structure 19 of spherical shape is provided for the substrates to be treated. Further shown in s removable cover 20 for opening the apparatus, provided with an inspection glass 21.

By sorption, in connection with this specification, any kind of fixing gas to the walls in a reversible manner is understood. Such a gas fixation is frequently described as adsorption when a fixing to the surface is assumed, or as absorption when it is assumed that the fixed gas has penetrated deeper into the wall, or also as chemisorption when the fixation is attributed to a reversible chemical reaction taking place on the surface or in the interior of the wall.

While specific embodiments of the invention have been shown and described in detail to illustrate the application of the principles of the invention, it will be understood that the invention may be embodied otherwise without departing from such principles.

What is claimed is:

1. A method of producing high vacuum in a closable container into which, at least during the flooding and while the container is open, a protective gas is introduced to protect the inside wall from being charged with vapor, comprising screening the inside wall by a covering while introducing a protective gas into an intermediate space between the wall of the container and the covering, evacuating the container, and during the evacuation heating the covering.

2. A method according to claim 1 wherein at least 80% of the inside wall is screened by the covering.

3. A method according to claim 1, wherein protective gas is introduced while the container is open.

4. A method according to claim 1, wherein the protective gas is introduced during the heating.

5. A method of producing a high vacuum in a vacuum container having an exhaust connection line connected thereto and using an interior protective covering and a protective gas, comprising applying the covering to the interior of the container so as to shield a major portion of the walls thereof and at least a portion of the exhaust connection, directing a protective gas into the space between the covering and the interior walls of the container, therafter evacuating the interior of the container through the exhaust connection, and heating the covering.

6. A method according to claim 5 wherein the protective gas is introduced primarily during the flooding of the container while the container is open.

7. A method according to claim 5 wherein the gas is throttled during the evacuation of the container, and after heating it is shut off.

8. A method according to claim 5 including shielding the exhaust connection by use of a heatable thin-walled flap screen, adjusting the flap screen so that it fully opens the exhaust connection during heating, after heating adjusting the flap screen to effect a gas conductance at which the pressure in the container assumes a minimum value and is then adjusting the flap screen to close the exhaust connection during subsequent opening and flooding.

* * * * *